US010336599B2

(12) United States Patent
Miles

(10) Patent No.: US 10,336,599 B2
(45) Date of Patent: Jul. 2, 2019

(54) COVER FOR A WATER COOLER RESERVOIR BOTTLE

(71) Applicant: Alfred Dean Miles, New Cumberland, PA (US)

(72) Inventor: Alfred Dean Miles, New Cumberland, PA (US)

( * ) Notice: Subject to any disclaimer, the term of this patent is extended or adjusted under 35 U.S.C. 154(b) by 382 days.

(21) Appl. No.: 15/005,816

(22) Filed: Jan. 25, 2016

(65) Prior Publication Data

US 2017/0015477 A1 Jan. 19, 2017

Related U.S. Application Data

(63) Continuation-in-part of application No. 14/483,381, filed on Sep. 11, 2014, now abandoned, which is a continuation of application No. PCT/US2013/030437, filed on Mar. 12, 2013.

(60) Provisional application No. 61/609,481, filed on Mar. 12, 2012.

(51) Int. Cl.

| | |
|---|---|
| ***B65D 23/08*** | (2006.01) |
| ***B65D 81/36*** | (2006.01) |
| ***B67D 3/00*** | (2006.01) |

(52) U.S. Cl.

CPC ..... *B67D 3/0096* (2013.01); *B65D 23/08* (2013.01); *B65D 81/365* (2013.01); *B65D 2203/00* (2013.01)

(58) Field of Classification Search

CPC ..... B65D 23/08; B65D 77/0406; B65D 77/0486; B65D 81/365; B67D 3/0067; B67D 3/0096

See application file for complete search history.

(56) References Cited

U.S. PATENT DOCUMENTS

| | | | | |
|---|---|---|---|---|
| D23,399 | S | 6/1894 | Lee | |
| 2,142,301 | A | 1/1939 | Buchalter | |
| D231,762 | S | 6/1974 | Stott | |
| 3,906,129 | A | 9/1975 | Damois | |
| D266,056 | S | 9/1982 | Lear | |
| 4,566,292 | A * | 1/1986 | Parmet | F25D 3/08 215/286 |
| D289,614 | S | 5/1987 | Sanchez et al. | |
| 4,834,250 | A | 5/1989 | Dumbeck et al. | |
| 4,892,771 | A | 1/1990 | Rowland | |
| 5,356,046 | A | 10/1994 | Burke | |
| 5,454,492 | A | 10/1995 | Hunter et al. | |
| D396,772 | S | 8/1998 | Hanzok | |

(Continued)

FOREIGN PATENT DOCUMENTS

DE 202004007752 U1 11/2004

*Primary Examiner* — Andrew T Kirsch

(74) *Attorney, Agent, or Firm* — Blynn L. Shideler; Krisanne Shideler; BLK Law Group

(57) ABSTRACT

An aesthetically pleasing decorative cover for a water cooler or water cooler reservoir bottle helps to transform the bottle from a bottle into a likeness of a person or animal without completely covering the water cooler or water cooler reservoir bottle. The decorative cover may be a three dimensional simulation of sports headgear and can include a cap to allow the user to wear the cover in a "bobble head" fashion through a cap with elastic straps. Additional features include a liner bowl for use as a chip and/or ice bowl, and may include a pivoted handle/simulated face mask.

7 Claims, 8 Drawing Sheets

(56) References Cited

U.S. PATENT DOCUMENTS

| | | | | |
|---|---|---|---|---|
| 5,797,507 | A * | 8/1998 | Kramer | A63H 3/005 206/457 |
| D402,845 | S | 12/1998 | Hanzok | |
| D411,076 | S | 6/1999 | Evers | |
| 5,990,790 | A * | 11/1999 | Lusareta | A47G 23/0306 206/459.1 |
| D429,047 | S | 8/2000 | Hirtel | |
| D438,425 | S | 3/2001 | Agnew | |
| D459,213 | S | 6/2002 | Buboltz et al. | |
| 6,550,271 | B2 * | 4/2003 | Silbert | A45C 11/20 62/371 |
| D479,426 | S | 9/2003 | Callahan | |
| D504,621 | S | 5/2005 | Bowling | |
| D539,588 | S | 4/2007 | Picache | |
| D612,671 | S | 3/2010 | Sanchez et al. | |
| D618,498 | S | 6/2010 | Sanchez et al. | |
| D621,704 | S | 8/2010 | Lymn et al. | |
| D671,420 | S | 11/2012 | Godge et al. | |
| D692,309 | S | 10/2013 | Sevee | |
| D701,772 | S | 4/2014 | Ortiz | |
| 2003/0071068 | A1 | 4/2003 | Burrows | |
| 2003/0150878 | A1 | 8/2003 | Borbone | |
| 2004/0065636 | A1 | 4/2004 | Thibodeau et al. | |
| 2008/0314861 | A1 | 12/2008 | Goldburt | |
| 2012/0267383 | A1 | 10/2012 | Van Rooyen | |
| 2013/0134174 | A1 * | 5/2013 | Tessier | A47G 19/2227 220/694 |
| 2015/0001174 | A1 | 1/2015 | Miles | |

* cited by examiner

COVER FOR A WATER COOLER RESERVOIR BOTTLE

RELATED APPLICATIONS

This application is a continuation-in-part of U.S. patent application Ser. No. 14/483,381 filed Sep. 11, 2014, entitled "A Cover for A Water Cooler Reservoir Bottle" and which published Jan. 1, 2015 and Publication Number 2015-0001174, which is incorporated herein by reference. U.S. patent application Ser. No. 14/483,381 is a continuation of international patent application PCT/US2013/030437 filed Mar. 12, 2013, entitled "A Cover for a Water Cooler Reservoir Bottle" and which published Sep. 19, 2013 as publication WO 2013-138301, which is incorporated herein by reference. International patent application PCT/US2013/030437 claims priority to U.S. patent application Ser. No. 61/609,481 filed Mar. 12, 2012, entitled "Human Headgear for Solid Articles" which application is incorporated herein by reference in its entirety.

BACKGROUND INFORMATION

1. Field of the Invention

The present invention relates generally to covers for water coolers, water bottles, and water cooler reservoir bottles.

2. Background Information

German Patent DE 202004007752U1 published in 2004 discloses a drink container lamp which combines a conventional drink container with a light source and the functions of the light source are controlled by operating the opening and closing mechanism of the drink container. The light source can be arranged inside or outside the drink container. The light source can be enclosed by a transparent body outside the container.

U.S. Design Pat. No. 539,588 from 2007 discloses an ornamental cover for a water cooler. U.S. Design Pat. No. 438,425 from 2001 discloses an ornamental windowed and zippered cover for a water dispensing bottle. U.S. Design Pat. No. 479,426 from 2003 discloses an ornamental water cooler bottle cover.

U.S. Pat. No. 5,454,492 issued in 1995 discloses a decorative cover which easily fits over a water bottle mounted on a water dispenser. This cover provides a variably changeable decor that can fit different tastes and environments. Further, this cover includes accessory features such as a handle for easy removal of the cover, a cup dispenser, and a pouch for storing water delivery schedules, bills and the like. In one embodiment the cover is constructed of a loose fitting material and includes a top portion and a side portion. In an alternate embodiment the cover is constructed of a rigid material designed to stand on its own around the water bottle. In this embodiment the cover can include a top portion or can leave the water bottle exposed on the top. This rigid material can be foam rubber coated with plastic for writing and erasing messages or metallic for attaching messages by magnetic means. Both the loose-fitting and the rigid embodiments of the cover can be made with strategically positioned viewing ports in them for determining the water level in the water bottle and allowing light to reach the interior of the water bottle. The viewing ports can be made from the absence of any material or can be constructed of a Nylon mesh material. The cover can also include an interior liner which is used to absorb moisture away from the water bottle.

United States Patent No. 2003-0071068 published in 2003 discloses an illuminated water cooler. The bottled water cooler includes at least one and preferably a plurality of lights for illuminating a transparent water bottle mounted onto a cooler housing in an inverted orientation. The lights are mounted on the cooler housing for illuminating the bottle generally at a bottle shoulder along an annular contact zone supported on the cooler housing. The lights shine generally upwardly through the transparent bottle wall and into the bottle interior to illuminate the bottle and its contents, resulting in an attractive and refreshing appearance.

All of the above identified patents and publications are hereby incorporated by reference in their entireties. It is an object of the present invention to address these deficiencies of the existing prior art.

SUMMARY OF THE INVENTION

This invention is directed to a cost effective, efficient, cover for a water cooler reservoir bottle that overcomes at least some of the drawbacks of the existing designs. The present invention may include a cover, sleeve, or jacket that receives an article. The cover may include a body with an interior body surface sized and shaped to receive an object, such as an exterior body surface of a five gallon water cooler reservoir bottle. An exterior surface of the body may define the shape of an object, a partial head having ears, a top of a head, and sides of the head, head gear, or a head cover. One example is a body in the form of an American football helmet. A pair of eyes, a faceguard, a nose, and a mouth, alone or in any combination, may be integrally formed with the body or be each separately distinct from the body. In other body configurations, as listed below, other accessories (mask, scarf, garment, tie, bandana, facial features, etc.) in addition to the facial/head features listed above can be integrally formed with a body or provided as distinct and separate articles.

The present invention may further include a water cooler reservoir bottle decoration kit. The kit may include a body having an interior body surface sized and shaped to be immediately adjacent to an exterior body surface of a water cooler reservoir bottle, such as a three, four, five, or six gallon capacity water cooler reservoir bottle. An exterior body surface of the body may define the shape of a sports helmet. The kit may include a pair of eyes, a nose, a mouth, and a faceguard, alone or in any combination, that are not integrally formed with the body. The kit may further include, alone or in any combination, a vibration sensor, a sound generator, and lights.

Another embodiment of the present invention may include a combined water cooler reservoir bottle and removable head gear or partial head. The water cooler reservoir bottle may include a cylindrical body, two opposed ends, an opening defined in one of the two opposed ends, and a handle that extends in a direction perpendicular to the two opposed ends and parallel to the opening. The removable head gear or partial head may include a body that receives a water cooler reservoir bottle. The body does not fully obscure the handle so that the handle and an area of the exterior body surface of the water cooler reservoir bottle immediately surrounding the handle is visible when the body is carried by the water cooler reservoir bottle. The body may define a body opening. The body opening may expose facial features defined by a water cooler reservoir bottle. The body opening may be sized and shaped so that eyes and a nose carried by the water cooler reservoir bottle can be seen when the body is carried by the water cooler reservoir bottle.

These and other aspects of the present invention will be clarified in the description of the preferred embodiment of the present invention described below in connection with the attached figures in which like reference numerals represent like elements throughout.

BRIEF DESCRIPTION OF THE PREFERRED EMBODIMENTS

This invention is directed to a cost effective, efficient, cover for a water cooler reservoir bottle that overcomes at least some of the drawbacks of the existing designs. The invention comprises a body that defines an interior body surface, wherein the interior body surface of the body defines a cavity sized and shaped to receive a water cooler reservoir bottle and the body does not completely cover the external body surface of the water cooler reservoir bottle. U.S. Provisional Patent Application Ser. No. 61/609,481, filed Mar. 12, 2012 entitled "Human Headgear for Solid Articles", and international patent application PCT/US2013/030437 filed Mar. 12, 2013, entitled "A Cover for a Water Cooler Reservoir Bottle" and which published Sep. 19, 2013 as publication WO 2013-138301, are hereby incorporated by reference in its entirety.

The present invention is used to visually transform an object that does not have a human, animal, or specific article appearance into a new object that does have a human-like, animal-like, or specific article appearance. For example, a water cooler reservoir bottle may be transformed into the shape of a head or some other object. The invention is not limited to water coolers or water cooler reservoir bottles.

Figure 1:
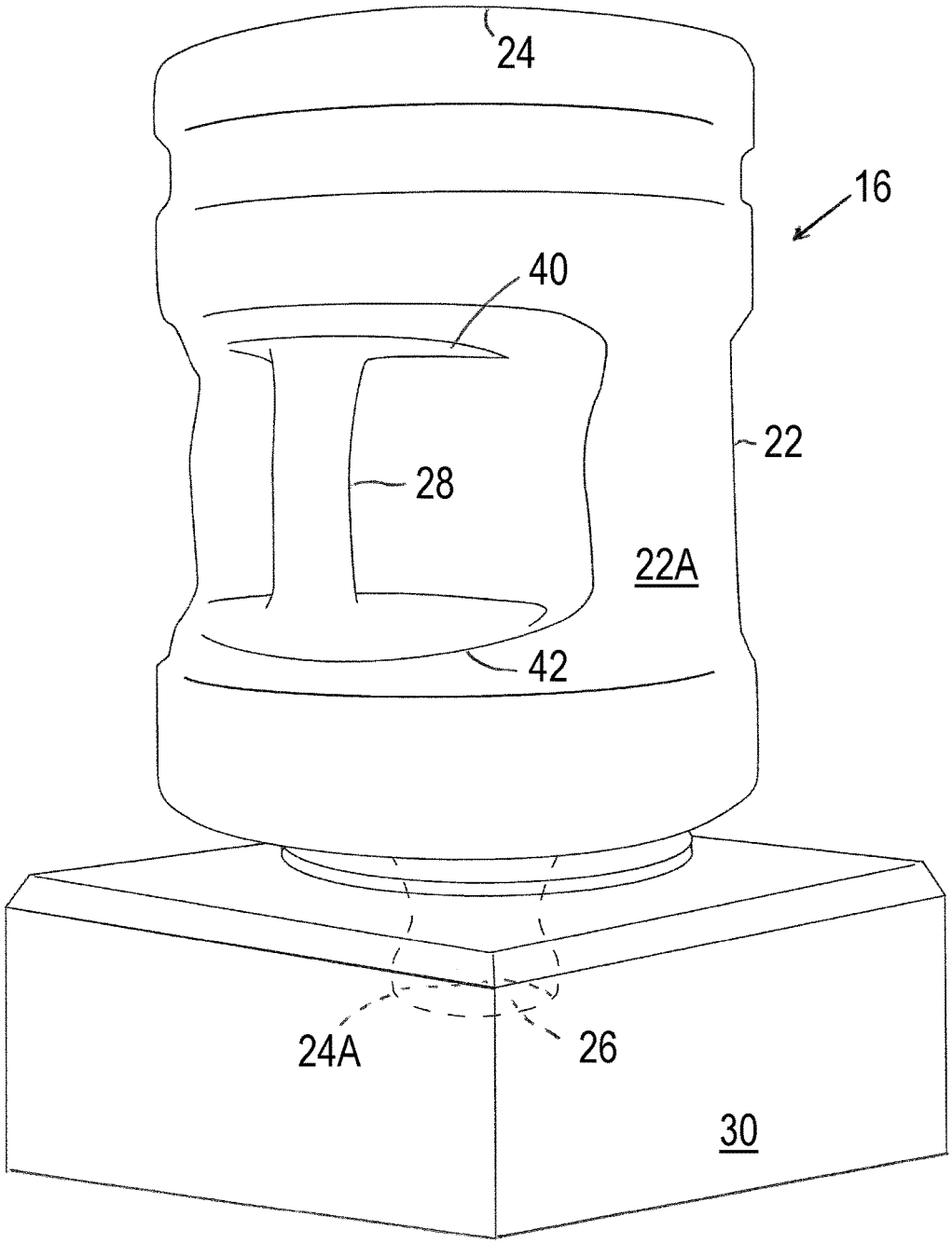
FIG. 1 is a perspective view of a water cooler and a water cooler reservoir bottle.

A water cooler reservoir bottle 16 is shown in FIG. 1. The water cooler reservoir bottle 16 may include a cylindrical body 22, an exterior body surface 22A, two opposed ends 24, 24A, an opening 26 defined in one of the two opposed ends 24, 24A, and handle 28 that extends in a direction perpendicular to the two opposed ends 24, 24A and parallel to the opening 26. A first ridge 40 and a second ridge 42 may also be defined by the water cooler reservoir bottle 16. A separate water cooler 30 is also shown. The removable water cooler reservoir bottle 16 is shown inverted in the water cooler 30. The exterior body surface 22A may be generally defined by the portion of the cylindrical body 22 that extends above an uppermost surface of the water cooler 30 when the water cooler reservoir bottle 16 is mounted to the water cooler 30. The exterior body surface 24A may or may not include a flat top adjacent to opposed end 24 of the water cooler reservoir bottle 16.

The water cooler reservoir bottle 16, standing alone, does not immediately convey a human, animal, or non-water bottle form. However, one discovery is that features defined by the water cooler reservoir bottle 16 itself can be highlighted by a cover or body to give the water cooler reservoir bottle 16 a new and unrelated visual appearance.

Figure 2:
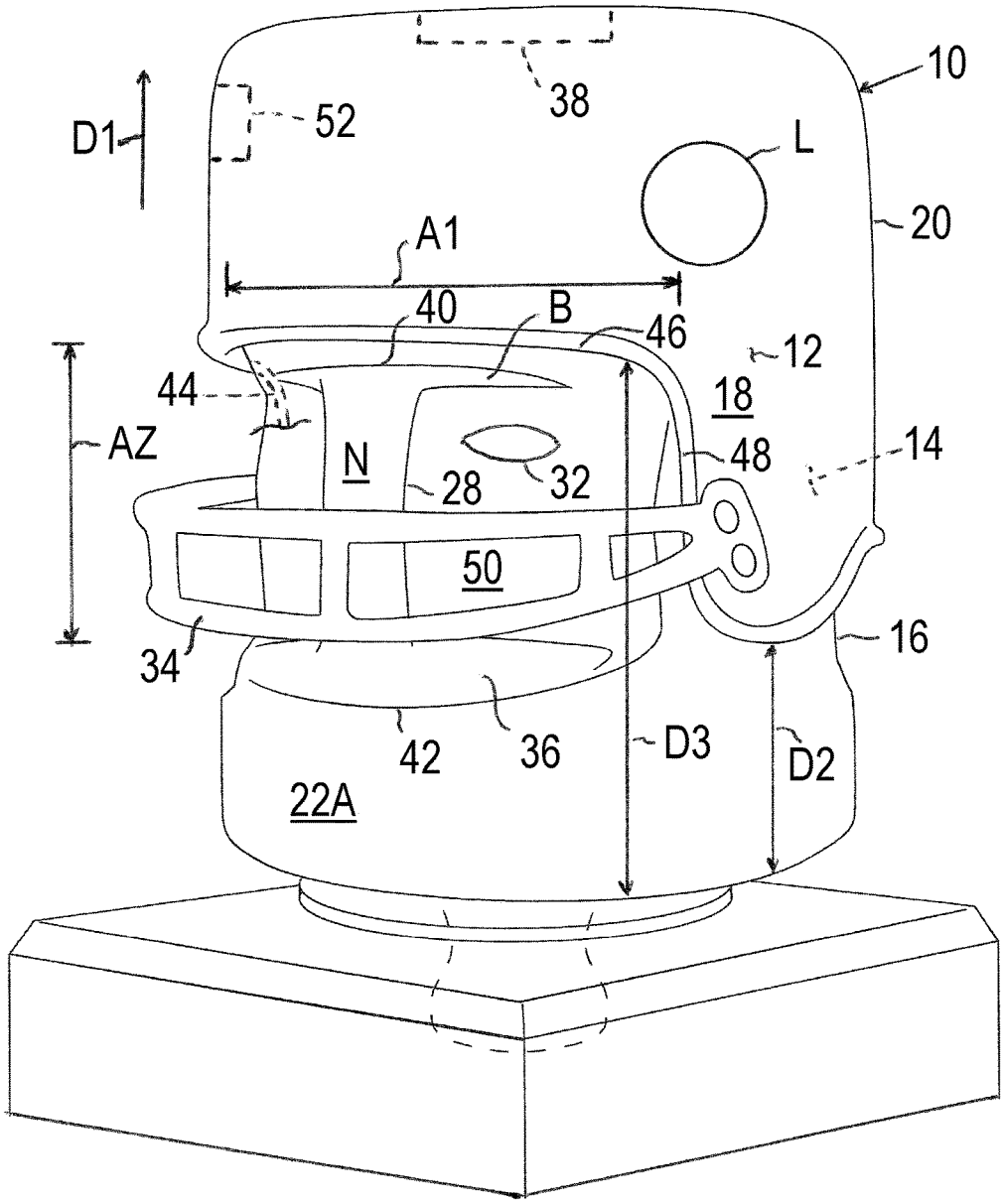
FIG. 2 is a perspective view of a water cooler, water cooler reservoir bottle, and a cover according to a first embodiment of the present invention.

One example is a sleeve, jacket, or cover 10 shown in FIG. 2. The cover 10 may include a body 12 sized and shaped such that an interior body surface 14 of the body 12 partially covers, partially receives, or is adapted to partially fit over an exterior body surface 22A of the water cooler reservoir bottle 16. For example, distances D2 and D3 are not covered by the body 12. An exterior body surface 18 of the body 12 may define the shape of a human head cover 20 or head gear such as a hat or wig, a partial animal head, a partial human head, or an object. The body 12 may further define a body opening 50 that is sized and shaped so that the body 12 does not visually obscure portions of the exterior body surface 22A such when the body 12 is carried by the water cooler reservoir bottle 16 such that facial features defined by or carried on a water cooler reservoir bottle 16 can be seen by an observer.

The facial features can be abstract facial features defined by a water cooler reservoir bottle 16 itself separate and discrete objects that may be added to the exterior body surface 22A of a water cooler reservoir bottle 16. The water cooler reservoir bottle 16, the body opening 50, and the body 12 generally combine to define an abstract likeness of a human face, a human head, an object, an animal face, or an animal head.

The body 12 in FIG. 2 defines an American-style football helmet. The water cooler reservoir bottle 16 defines the handle 28. The handle 28 extends in a direction perpendicular to the two opposed ends 24, 24A of the water cooler reservoir bottle 16. In combination with the body 12, the handle 28 forms an abstract likeness of a human nose N. Body opening 50 helps to frame and highlight facial features from the exterior body surface 22A and also permits the handle 28 to remain functional when the body 12 is carried by the water cooler reservoir bottle 16. When the body 12 is carried by the water cooler reservoir bottle 16, the handle 28 is not fully obstructed from view by the body 12 and the handle 28 is least partially visible. The water cooler reservoir bottle 16 may also include a first ridge 40. By itself, first ridge 40 is non-descript. However, when a body 12 is carried by the water cooler reservoir bottle 16 in a proper way, the first ridge 40 forms an abstract likeness of a human brow B or forehead. The water cooler reservoir bottle 16 may further include a second ridge 42 that forms an abstract likeness of a human mouth 36. Again, the body 12 gives these features visual context and helps to transform bumps, ridges, and lines defined by the water cooler reservoir bottle 16 into an aesthetically pleasing visual depiction of a person or thing.

The interior body surface 14 of the body 12 may further define a cavity sized and shaped to receive the largest diameter portion of a water cooler reservoir bottle 16. An exterior surface 18 of the body 12 defines the shape of a portion of a human head, an animal head, an object or thing, or a human head cover 20. The body 12 defines an American football helmet. Other examples include, but are not limited to, sports headgear, American football helmet (FIG. 1) without a faceguard, rugby helmet or headgear, equestrian polo helmet or headgear, hockey helmet or headgear, hair or wig, baseball helmet, hockey helmet, wrestling helmet, golf headgear, NASCAR/Formula One helmet, motorcycle helmet, rugby helmet, skateboard helmet, snowboard helmet, military helmet or headgear, fireman helmet or headgear (FIG. 4), police helmet or headgear, cab driver headgear, bus driver headgear, postal headgear, fisherman headgear, sombreros, cowboy hats and headgear, coonskin caps, safari headgear, beach headgear, visors, construction hats and headgear, chef hats and headgear, a tooth or other visual representation of a profession or occupation, sports equipment, a partial animal head (ears and rear/sides of head), crowns, Uncle Sam hat, Santa Clause hat and beard (FIG. 3), holiday heads (cat, witch, St. Patrick, cupid, etc.) or headgear, business headgear, marching band hats and headgear, birthday party hats and headgear, bridal veil, groom headgear, knight headgear, or any other type of head or head cover.

With continued reference to FIG. 2; when the body 12 receives a water cooler reservoir bottle 16, a body opening 50 with an area generally defined by dimensions A1 times A2. A1 and A2 are lengths of the first and second edges 44, 46 or the second and third edges 46, 48 of the body 12. The body opening 50 partially physically frames and visually transforms bumps and curves on the water cooler reservoir bottle 16 into abstract facial features such as a brow, nose, and mouth B, N, 36. The interior body surface of the body 12 has an overall body area that is numerically smaller than a cylindrical body surface area of the water cooler reservoir bottle. Stated another way, the body 12 does not completely cover the exterior body surface of the water cooler reservoir bottle. The exterior body surface 22A may be generally defined by the portion of the cylindrical body 22 that extends above an uppermost surface of the water cooler 30 when the water cooler reservoir bottle 16 is mounted to the water cooler 30. The exterior body surface 24A may or may not include a flat top adjacent to opposed end 24 of the water cooler reservoir bottle 16.

Figure 4:
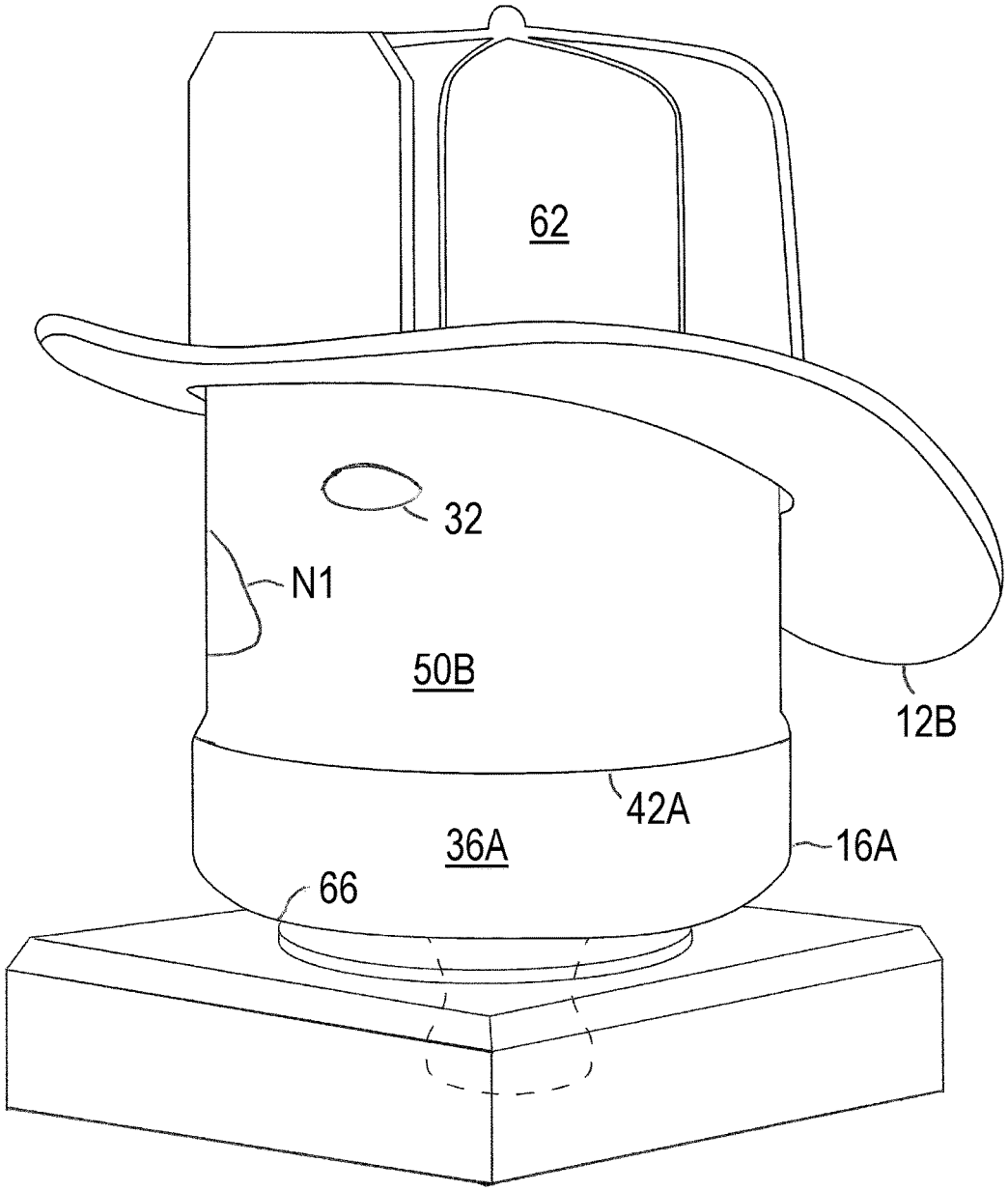
FIG. 4 is a perspective view of a water cooler, water cooler reservoir bottle, and a cover according to a third embodiment of the present invention.

With continuing reference to FIG. 2, body 12 may include a faceguard 34 and a location L for a logo. The location L of the logo or logos may be on any exterior surface 18 of the body 12. Eyes 32 (one shown for clarity), faceguard 34, and mouth 36 may be integral with the body 12, or may be pieces of a kit which are not integrally formed with the body 12. If a water cooler reservoir bottle 16 with a handle 28 is used, the handle 28 can attach to the faceguard 34 to form a vertical portion of the faceguard 34. In this case, an optional nose (not shown; FIG. 4) or a photograph of a person's eyes and nose may be positioned on the cylindrical body 22, directly behind the handle 28. Alternatively, the faceguard 34 can pass under the handle 28 and the handle 28 can define an abstract human nose N. The body 12 may further include a vibration sensor 38 that detects air bubbles rising in the water cooler reservoir bottle 16 in a direction D away from the opening 26. The vibration sensor 38 can be electrically connected to power source, a sound generator, or one or more lights 52. The sound generator and lights may also be connected to a respective power source. When activated, the vibration/motion sensor 38 will trigger a sound, a visual light, or both. The sound can be a voice, a song, etc. Lights can be selected to illuminate liquid in the water cooler reservoir bottle 16 and can be of any visual wavelength or wavelengths.

Figure 3:
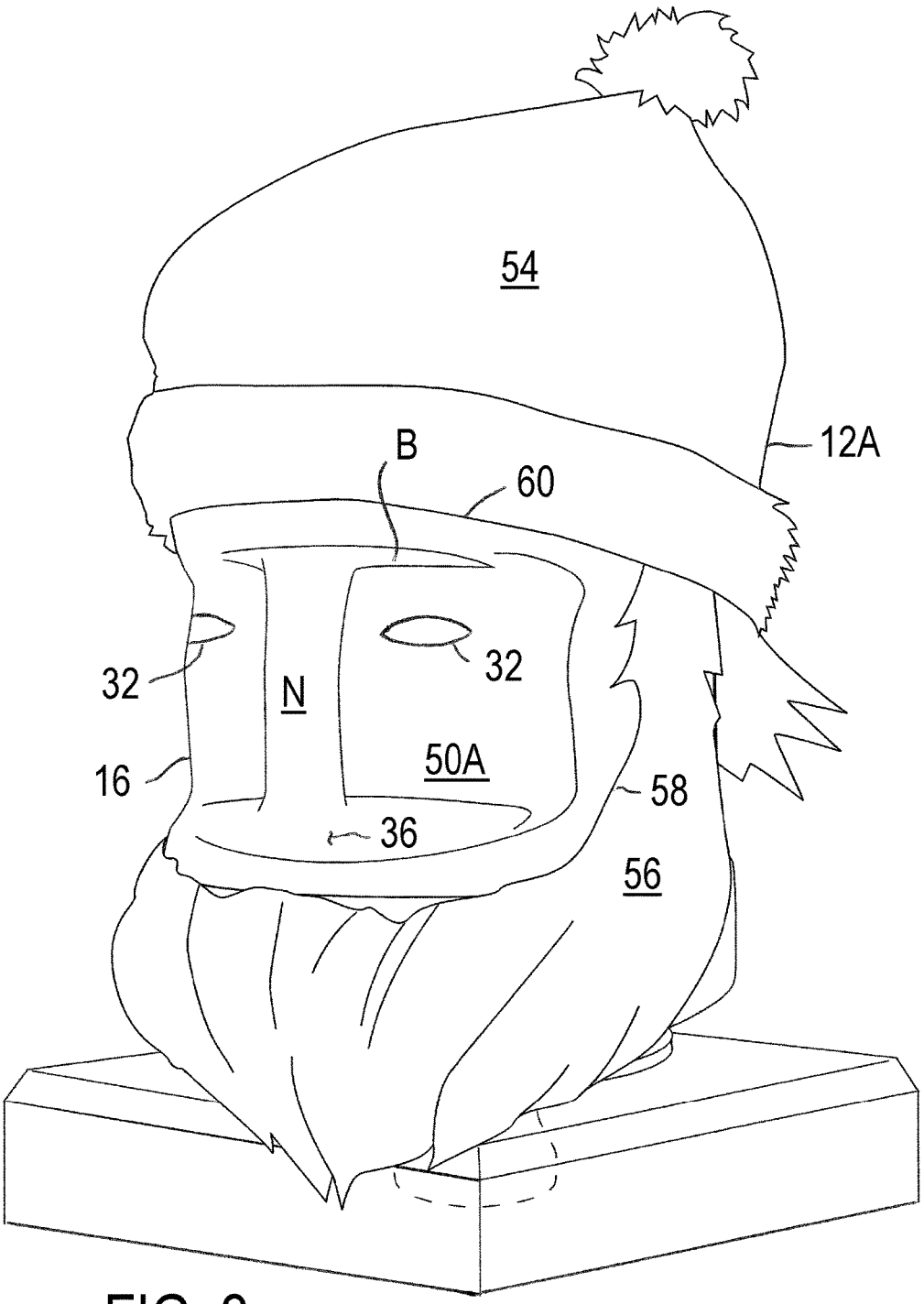
FIG. 3 is a perspective view of a water cooler, water cooler reservoir bottle, and a cover according to a second embodiment of the present invention.

FIG. 3 shows an example body 12A that defines a Santa hat 54 and beard 56. The body 12A is carried by a water cooler reservoir bottle 16. Beard edge 58 and hat edge 60 partially define body opening 50A. As with FIG. 2, the body opening 50A exposes and helps to define abstract facial features, such as a nose N, brow B, mouth 36, eyes 32, or an eye patch (not shown).

FIG. 4 shows an example body 12B that defines a fireperson's helmet 62. The body 12B is carried by a water cooler reservoir bottle 16A. In this embodiment, a body opening 50B remains unobstructed from view so that distinct and discrete facial features such as discrete eyes 32 and a nose N1 can be added to the exterior body surface 22A of the water cooler reservoir bottle 16A. The body opening 50B provides a clean palette that decorative objects, such as facial objects, can be added to. The water cooler reservoir bottle 16A shown in FIG. 4 does not have a handle 28. However, there are other features of the water cooler reservoir bottle 16A that are given visually aesthetic context by the body 12B. For example, second edge 42A and bottom 66 of the water cooler reservoir bottle 16A can be used to define a mouth 36A.

The body 12, 12A, 12B may be made from any type of plastic, resin, or Mylar material. The body 12, 12A, 12B may be rigid, collapsible, foldable, or inflatable by compressible or non-compressible fluid, depending on the material selected. The body 12, 12A, 12B may be formed partially or in its entirety by injection molding, as a flat sheet that can be wrapped around the water cooler reservoir bottle 16, 16A, or as a flat bag with at least one open side that slides over the water cooler reservoir bottle 16, 16A. The body 12, 12A, 12B may also include a phosphorescent material that illuminates in dark areas. The body 12, 12A, 12B may be made from a cloth material that can carry removable patches or logos L, such as by hook and latch attachment. This arrangement allows for a single body, such as body 12, to be decorated several different ways. For example, facial features of Employees-of-the-Month can be added and removed from a single body 12. The water cooler reservoir bottle 16 may be made from a clear plastic material and may be a three, four, five, six, seven, eight, nine, or ten gallon capacity replaceable water cooler reservoir bottle 16.

The present invention also includes a method. The method includes a step of selling or offering for sale a body that defines an interior cavity sized and shaped to fit over a water cooler reservoir bottle, wherein the body defines portions of a head or headgear and the body does defines a body opening that exposes a facial area on an exterior body surface of a receptacle or reservoir. The method may further include the step of advertising to the public that the body can be used to decorate the water cooler reservoir bottle 16. Another step includes advertising to the public that the body can be used with facial feature integrally formed with the body, separate and distinct from the body, or abstractly formed by a water cooler reservoir bottle to create a visual likeness of a person, animal, or object on a water cooler reservoir bottle.

Figure 5:
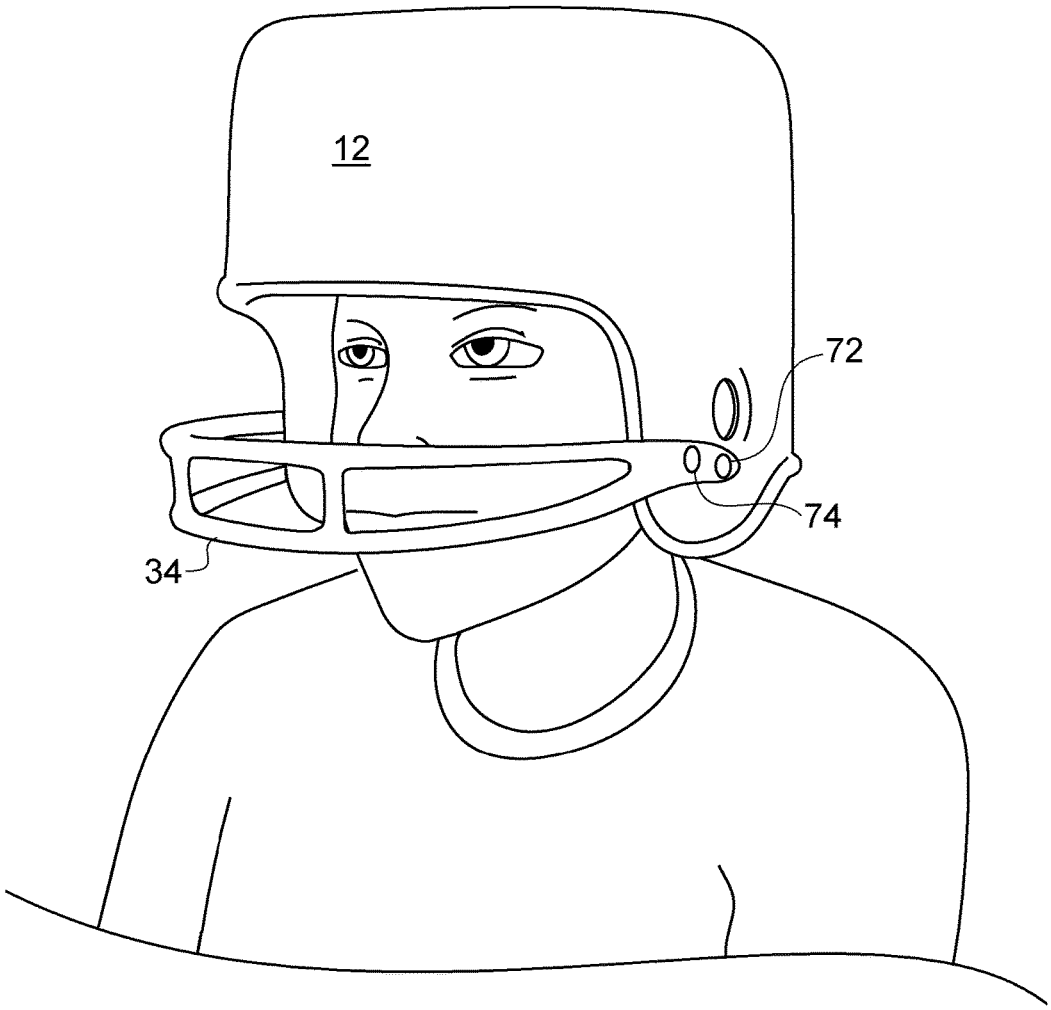
FIG. 5 is a perspective view of a water cooler reservoir bottle cover of FIG. 2 formed as a bobble head and worn by a user.
Figure 6:
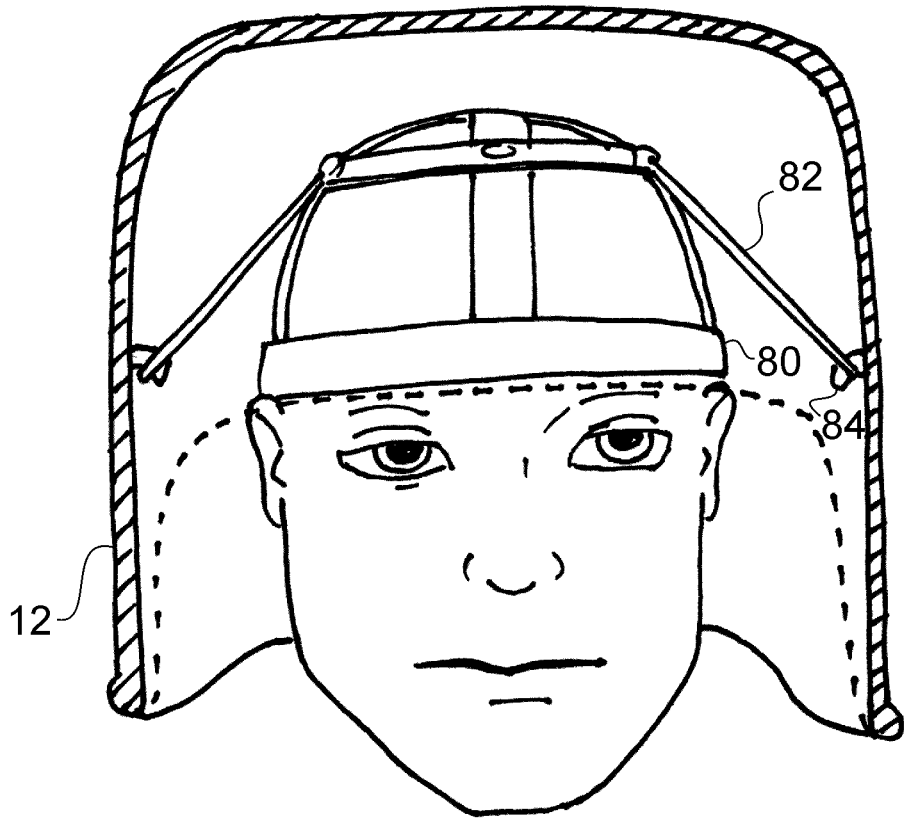
FIG. 6 is a cross section view of the water cooler reservoir bottle cover formed as a bobble head and worn by a user as shown in FIG. 5.

FIG. 5 is a perspective view of a water cooler reservoir bottle cover of FIG. 2 formed as a bobble head and worn by a user and FIG. 6 is a cross section view of the water cooler reservoir bottle cover formed as a bobble head and worn by a user as shown in FIG. 5. As discussed above, the body 12 in FIG. 2 defines a three dimensional simulated American-style football helmet. The present invention allows the body 12 to be utilized as more than a water cooler bottle cover, and can be worn by the user. The nature of the humans head relative to the water cooler bottle 16 requires the body 12 to be spaced on the typical humans head, in other words the body 12 would be too large to fit as a conventional helmet would on a typical human. The present invention provides a cap 80 to be worn by the user that is coupled via elastic (i.e., rubber) straps 82 to hooks 84 within the body 12. The hooks 84 are shown in an exaggerated fashion for clarity in FIG. 6, and need only be small elements to attach the elastic straps 82. The straps 82 can have a series of holes to allow for adjustable attachment to the hooks 84 to allow the user to adjust the relative position of the simulated helmet. The elastic straps 82, and the spacing between the top of the cap 80 and the top of the interior of the body 12 combine to give a "bobble head" aspect to the body 12 when worn by the user to increase the novelty effect of the helmet 12 when worn by the user. Essentially the elastic straps 82 will yield reciprocating reaction to forces and motion applied to the body 12. In other words a quick tap to the helmet will result in a bobbing motion, or a rapid turning of the user's head can yield a delayed reciprocating response of the helmet analogous to the response of the heads of what is known as bobble head figurines. Two straps 82 are shown but additional straps 82 with corresponding hooks 84 may be used to secure the helmet to the user as needed. The cap 80 and straps 82 are stored separately from the body 12 when the body 12 is on the water cooler bottle 16 and utilized with the cover by the user when desired to use the bobble head aspect (e.g., game day).

Figure 7:
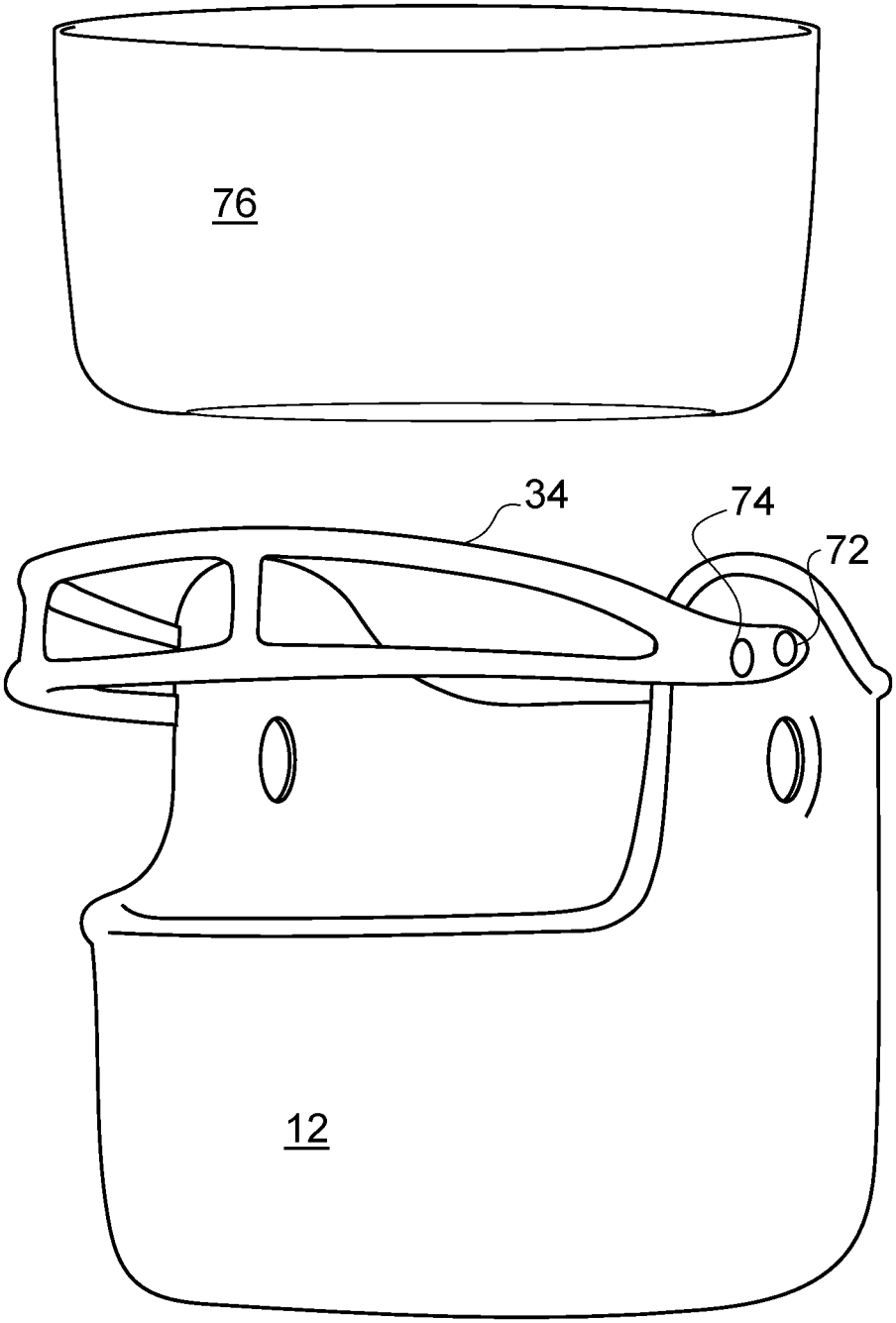
FIG. 7 is an exploded view of a water cooler reservoir bottle cover of FIG. 2 with associated liner bowl.
Figure 8:
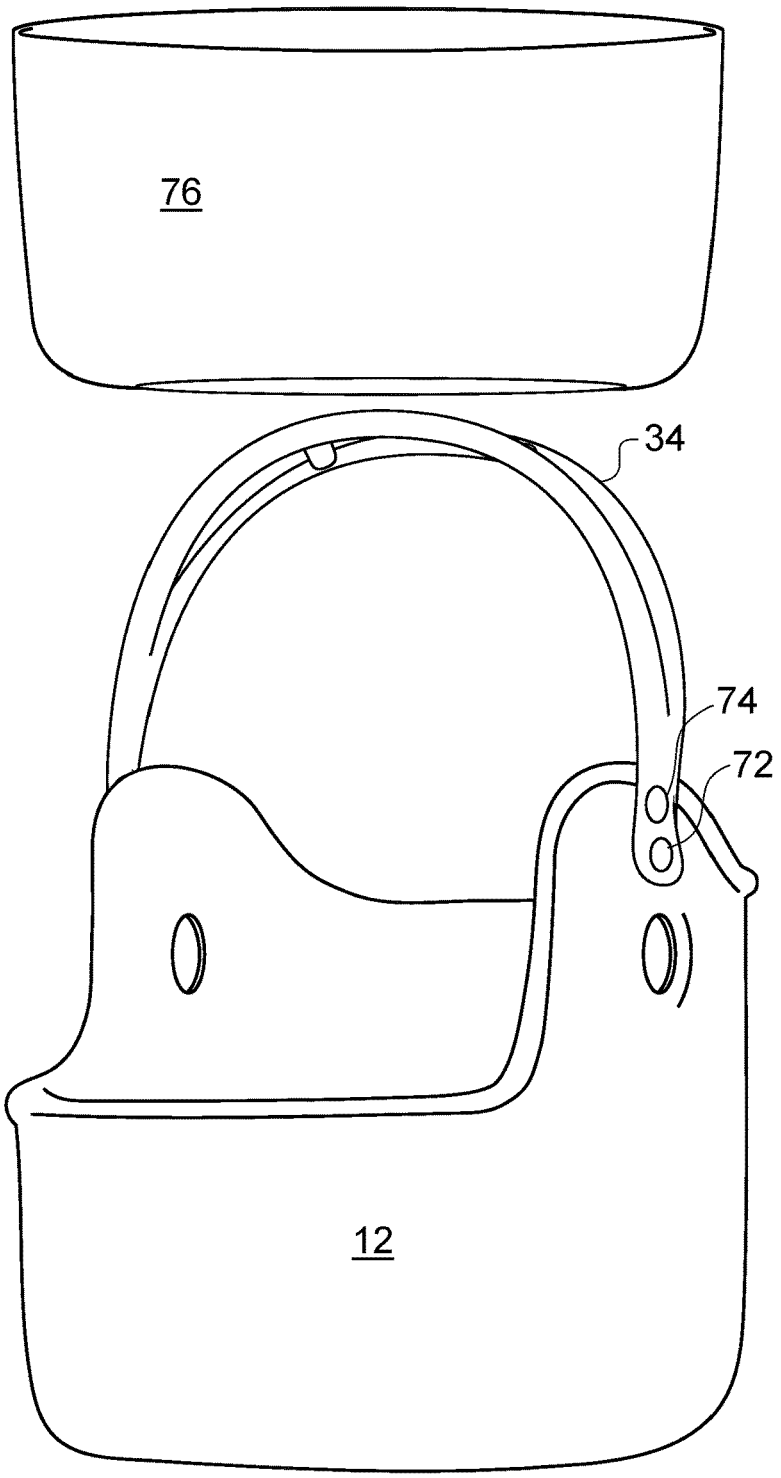
FIG. 8 is an exploded view of a water cooler reservoir bottle cover of FIG. 2 with associated liner bowl and with the face mask pivoted to a handle position.

FIG. 7 is an exploded view of a water cooler reservoir bottle cover of FIG. 2 with associated liner bowl 76. The liner bowl 76 fits into the interior of the body and allows the body to serve as a large serving bowl or ice bucket. Essentially the body 12 with liner 76 inserted can be set down upside down and utilized as a decorative chip bowl or ice bucket. FIG. 8 is an exploded view of a water cooler reservoir bottle cover of FIG. 2 with associated liner bowl and with the face mask 34 pivoted about pivot point 72 to a handle position for ease of carrying the body 12 with liner 76. A spring biased detent member 74 can be used to secure the face mask in the mask position of FIGS. 2 and 7 or the handle position of FIG. 8. The liner 76 could be formed to stay with the body 12 assuming it is sized to the bottle 16, or could be separate from the body 16 when the cover is coupled to the bottle 16.

FIGS. 5-8 are intended to illustrate the versatility of the cover of the present invention.

It should be understood that the foregoing illustrative embodiments have been provided merely for the purpose of explanation and are in no way to be construed as limiting of the invention. Any combination of any elements or embodiments described herein is contemplated. It is apparent that many variations to the present invention may be made without departing from the spirit and scope of the invention. The present invention is defined by the appended claims and equivalents thereto.

I claim:

1. A cover for a water cooler reservoir bottle comprising: a body that defines an interior body surface, wherein the interior body surface of the body defines a cavity sized and shaped to receive a water cooler reservoir bottle and wherein the body does not completely cover an external surface of the water cooler reservoir bottle, wherein an exterior of the body is a three dimensional simulation of one of a human headgear, a human head and an animal head including visual representation of elements of one of a human headgear, a human head and an animal head, and wherein the body further comprises a body opening and the body opening exposes facial features defined on a water cooler reservoir bottle upon which the cover is placed, and wherein the exterior of the body simulates human headgear including visual representations of one of sports headgear, wig, motorcycle helmet, military helmet, fireman helmet, police helmet, postal headgear, fisherman headgear, sombrero, cowboy hat, coonskin cap, safari headgear, beach headgear, visor, construction hat, chef hat, Uncle Sam hat, Santa Clause hat, marching band hat, bridal veil, and knight headgear, wherein the exterior of the body is a three dimensional representation of sports headgear, and a cap member for a user's head and configured to be coupled to the body to allow the body to be worn by the user, and wherein a plurality of straps couple the cap to the body.

2. The cover as claimed in claim 1, wherein the exterior of the body simulates one of an American football helmet, a hockey helmet and a baseball.

3. The cover as claimed in claim 2 further comprising a motion sensor carried by the body and electrically connected to a power source and further comprising lights carried by the body and electrically connected to a power source.

4. The cover as claimed in claim 2 wherein the plurality of straps are elastic and are configured to yield reciprocating reaction by the body relative to the cap for the user's head to forces and motion applied to the body.

5. The cover as claimed in claim 1, wherein the exterior of the body simulates one of an American football helmet, a hockey helmet and a baseball helmet and further including a separate liner for the interior of the body.

6. The cover as claimed in claim 5, further including a visual representations of a sports helmet face mask.

7. The cover as claimed in claim 6, wherein the simulated face mask is configured to pivot between a position simulating a face mask and a position which can be utilized as a handle carrying the inverted cover when removed from the water bottle.

* * * * *